US011383532B2

(12) United States Patent
Washio

(10) Patent No.: US 11,383,532 B2
(45) Date of Patent: Jul. 12, 2022

(54) DRYING DEVICE AND PRINTING APPARATUS

(71) Applicant: SEIKO EPSON CORPORATION, Tokyo (JP)

(72) Inventor: Yuichi Washio, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/725,424

(22) Filed: Dec. 23, 2019

(65) Prior Publication Data

US 2020/0207121 A1 Jul. 2, 2020

(30) Foreign Application Priority Data

Dec. 26, 2018 (JP) ..... JP2018-243143

(51) Int. Cl.
*B41J 11/00* (2006.01)

(52) U.S. Cl.
CPC ..... *B41J 11/00222* (2021.01); *B41J 11/0022* (2021.01)

(58) Field of Classification Search
CPC ..... B41J 11/00222; B41J 11/0022
See application file for complete search history.

(56) References Cited

U.S. PATENT DOCUMENTS 5,020,244 A * 6/1991 Smith ..... B41J 11/0022 34/633
9,975,351 B1 * 5/2018 Luedeman ..... B41J 11/002
2005/0144806 A1 7/2005 Yoshida
2013/0194367 A1 * 8/2013 Chiwata ..... B41J 11/0015 347/102
2015/0174924 A1 * 6/2015 Fuchioka ..... B41J 11/00222 347/102
2016/0159111 A1 6/2016 Sasaki
2017/0173975 A1 * 6/2017 Zuza Irurueta ..... B41J 11/002

FOREIGN PATENT DOCUMENTS

JP 2005195897 7/2005
JP 2010125819 6/2010
JP 2016107469 6/2016

* cited by examiner

*Primary Examiner* — Shelby L Fidler
(74) *Attorney, Agent, or Firm* — Workman Nydegger

(57) ABSTRACT

A drying device includes a support portion that supports a printed medium, a heating unit provided in a drying chamber for drying the medium supported by the support portion, a flow path member that forms an air flow path connecting an inflow port that opens downward in the vertical direction and the drying chamber, an air blowing unit that supplies, to the drying chamber, air flowing from the inflow port into the air flow path and causes the air to flow out of an outflow portion of the drying chamber, and a control unit that controls driving of the air blowing unit. The outflow portion is positioned lower than the inflow port in the vertical direction, and the control unit controls the driving of the air blowing unit to change an air flow rate of the air supplied to the drying chamber.

11 Claims, 5 Drawing Sheets

DRYING DEVICE AND PRINTING APPARATUS

The present application is based on, and claims priority from JP Application Serial Number 2018-243143, filed Dec. 26, 2018, the disclosure of which is hereby incorporated by reference herein in its entirety.

BACKGROUND

1. Technical Field

The present disclosure relates to a drying device that dries a printed medium, and a printing apparatus that performs printing on a medium.

2. Related Art

For example, as disclosed in JP-A-2005-195897, there is a drying device that blows dry air, which is an example of air, to dry a recording medium, which is an example of a medium. The drying device includes a drying chamber that dries the recording medium, an air flow duct, which is an example of a flow path member that guides dry air to the drying chamber, and a circulation duct that guides the dry air in the drying chamber to the air flow duct. The drying device dries the recording medium using the dry air circulating through the air flow duct, the drying chamber, and the circulation duct.

The air flow duct is provided with a heater, which is an example of a heating unit that heats the dry air. When heated dry air is circulated, the drying chamber can be efficiently warmed. However, when the dry air whose humidity has increased after drying the recording medium is circulated, there is a risk that condensation may occur.

SUMMARY

A drying device that solves the above-described problem includes a support portion configured to support a printed medium, a heating unit provided in a drying chamber for drying the medium supported by the support portion, a flow path member forming an air flow path connecting an inflow port that opens downward in a vertical direction and the drying chamber, an air blowing unit configured to supply air, flowing from the inflow port into the air flow path, to the drying chamber and cause the air to flow out of an outflow portion of the drying chamber, and a control unit configured to control driving of the air blowing unit. The outflow portion is positioned lower than the inflow port in the vertical direction, and the control unit controls the driving of the air blowing unit to change an air flow rate of the air supplied to the drying chamber.

A printing apparatus that solves the above-described problem includes a printing unit configured to perform printing on a medium, a support portion configured to support the printed medium, a heating unit provided in a drying chamber for drying the medium supported by the support portion, a flow path member forming an air flow path connecting an inflow port that opens downward in a vertical direction and the drying chamber, and an air blowing unit configured to supply air, flowing from the inflow port into the air flow path, to the drying chamber and cause the air to flow out of an outflow portion of the drying chamber, and a control unit configured to control driving of the air blowing unit. The outflow portion is positioned lower than the inflow port in the vertical direction, and the control unit controls the driving of the air blowing unit to change an air flow rate of the air supplied to the drying chamber.

DESCRIPTION OF EXEMPLARY EMBODIMENTS

First Embodiment

A first embodiment of a drying device and a printing apparatus will be described below with reference to the drawings. The printing apparatus is, for example, an ink jet-type printer that prints an image of characters, photographs, and the like on a medium such as a sheet by ejecting ink, which is an example of a liquid.

Figure 1:
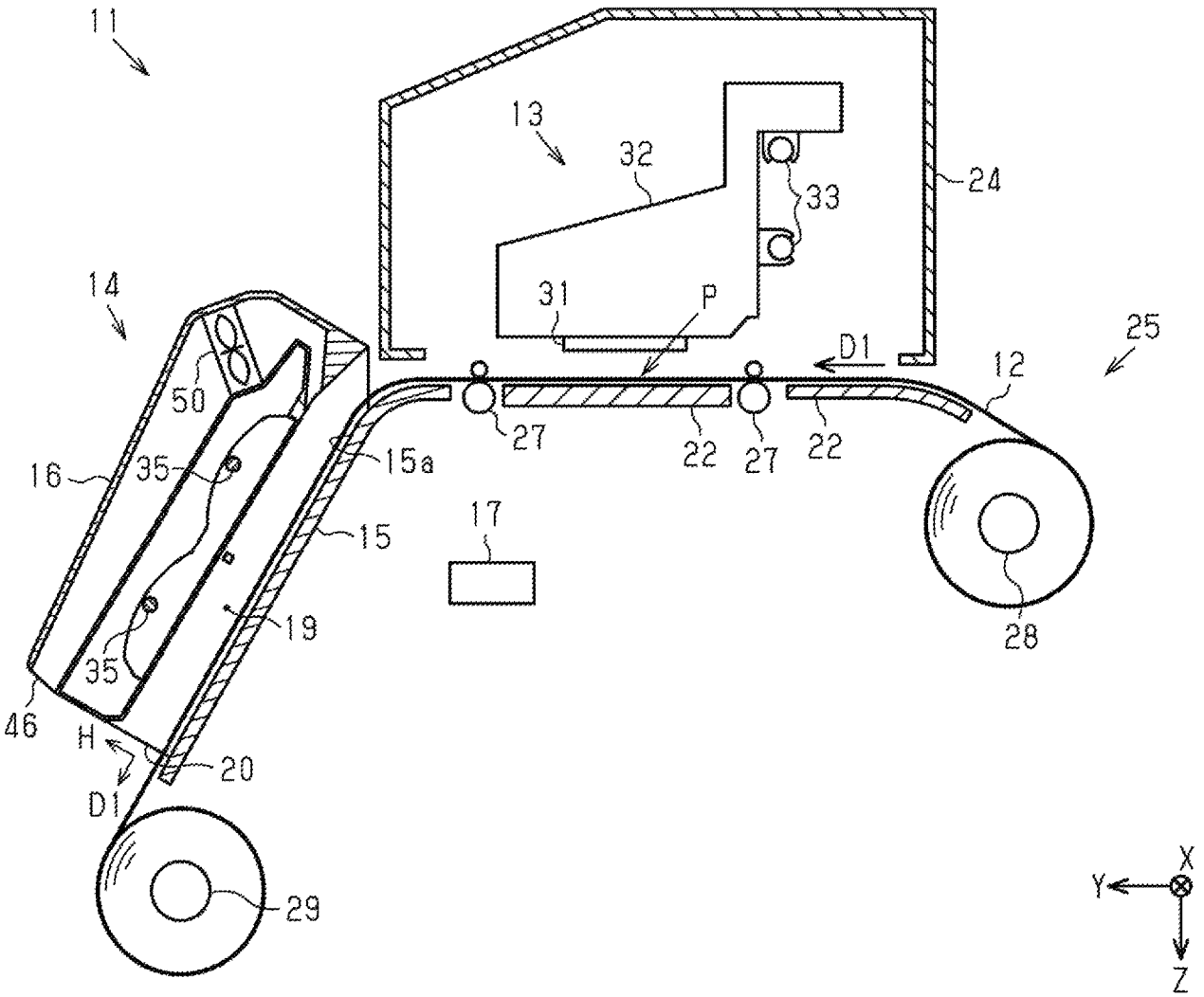
FIG. 1 is a schematic cross-sectional view illustrating a first embodiment of a printing apparatus.

As illustrated in FIG. 1, a printing apparatus 11 is provided with a printing unit 13 that performs printing on a medium 12, and a drying device 14 that dries the printed medium 12. The drying device 14 is provided with a support portion 15 including a support face 15*a* that supports the printed medium 12, a heating device 16 that heats the medium 12 supported by the support portion 15, and a control unit 17 that controls the drying device 14.

The control unit 17 is configured by a processing circuit and the like including a computer and a memory, for example. The control unit 17 controls various operations executed by the drying device 14 in accordance with a program stored in the memory. The control unit 17 may integrally control driving of each of mechanisms in the printing apparatus 11.

The drying device 14 includes a drying chamber 19, which is a space for drying the medium 12 supported by the support portion 15. The drying chamber 19 includes an outflow portion 20. Air in the drying chamber 19 flows out to the outside from the outflow portion 20. The outflow portion 20 is an opening formed by the support portion 15 and the heating device 16. In the present embodiment, the support portion 15 and the heating device 16 form the outflow portion 20 in a state of being separated from each other. In the present embodiment, the medium 12 that has been dried in the drying chamber 19 is discharged from the outflow portion 20. Note that the support 15 and the heating device 16 may have a configuration in which they are partially in contact with each other and have a predetermined gap therebetween, with the gap functioning as the outflow portion 20.

In the drawings, the direction of gravity is indicated by a Z axis while assuming that the printing apparatus 11 is placed on a horizontal surface, and directions along a plane intersecting the Z axis are indicated by an X axis and a Y axis. When the X, Y, and Z axes are orthogonal to each other, the X and Y axes follow the horizontal plane. In the following description, the X axis direction is also referred to as a width direction X of the medium 12, the Y axis direction as a horizontal direction Y, and the Z axis direction as a vertical direction Z. Of directions along the support face 15*a*, a direction in which the medium 12 is transported is also referred to as a transport direction D1. A direction perpendicular to a portion of the support face 15*a* configuring the outflow portion 20 is also referred to as a normal direction H. The transport direction D1 and the normal direction H are orthogonal to the X axis.

The printing apparatus 11 may be provided with a guide portion 22 that guides the medium 12 to the drying device 14. The guide portion 22 guides the medium 12 on which printing is being performed by the printing unit 13, or the medium 12 before the printing. In the drawings, the medium 12 is illustrated as being separated from the support portion 15 and the guide portion 22, but the medium 12 is transported in a state of being in contact with and slidably supported by the support portion 15 and the guide 22.

The printing apparatus 11 may be provided with a housing 24 that houses the printing unit 13, and a transport unit 25 that transports the medium 12 in the transport direction D1. The transport unit 25 may be provided with a transport roller 27 that transports the medium 12, a feeding shaft 28 positioned upstream of the transport roller 27 in the transport direction D1, and a winding shaft 29 positioned downstream of the transport roller 27 in the transport direction D1. The transport unit 25 may be provided with a plurality of the transport rollers 27. The feeding shaft 28 and the winding shaft 29 each rotatably support a roll around which the long medium 12 is wound into a cylindrical shape. The feeding shaft 28 feeds the medium 12 while unwinding the wound medium 12. The transport roller 27 transports the fed medium 12 along the guide portion 22 and the support portion 15. The winding shaft 29 takes up the transported medium 12.

The printing unit 13 is provided with a liquid ejection head 31 that ejects liquid from a nozzle, a carriage 32 that holds the liquid ejection head 31, and a guide shaft 33 that guides movement of the carriage 32. The carriage 32 reciprocates along the guide shaft 33 in the width direction X. While moving together with the carriage 32, the liquid ejection head 31 ejects the liquid toward the medium 12 positioned in a print position P. Printing is performed on the medium 12 as a result of the liquid being deposited thereon. Note that the printing unit 13 may be a printing unit that ejects the liquid over the width direction X of the medium 12 without moving in the width direction X.

The drying device 14 is provided further downstream than the printing unit 13 in the transport direction D1. The support portion 15 supports the printed medium 12, which is transported downstream in the transport direction D1, from the print position P at which the printing is performed on the medium 12. The support portion 15 is inclined from upstream to downstream in the transport direction D1 and also from an upper to lower side in the vertical direction Z. In other words, the support portion 15 is disposed such that an upstream portion of the support portion 15 in the transport direction D1 is positioned above a downstream portion thereof in the vertical direction Z.

The medium 12 transported by the transport unit 25 passes through the drying chamber 19. In the drying chamber 19, the medium 12 on which the printing has been performed by the printing unit 13 is heated and dried. The winding shaft 29 takes up the dried medium 12 that has been dried by passing through the drying chamber 19.

Next, the drying device 14 will be described.

Figure 2:
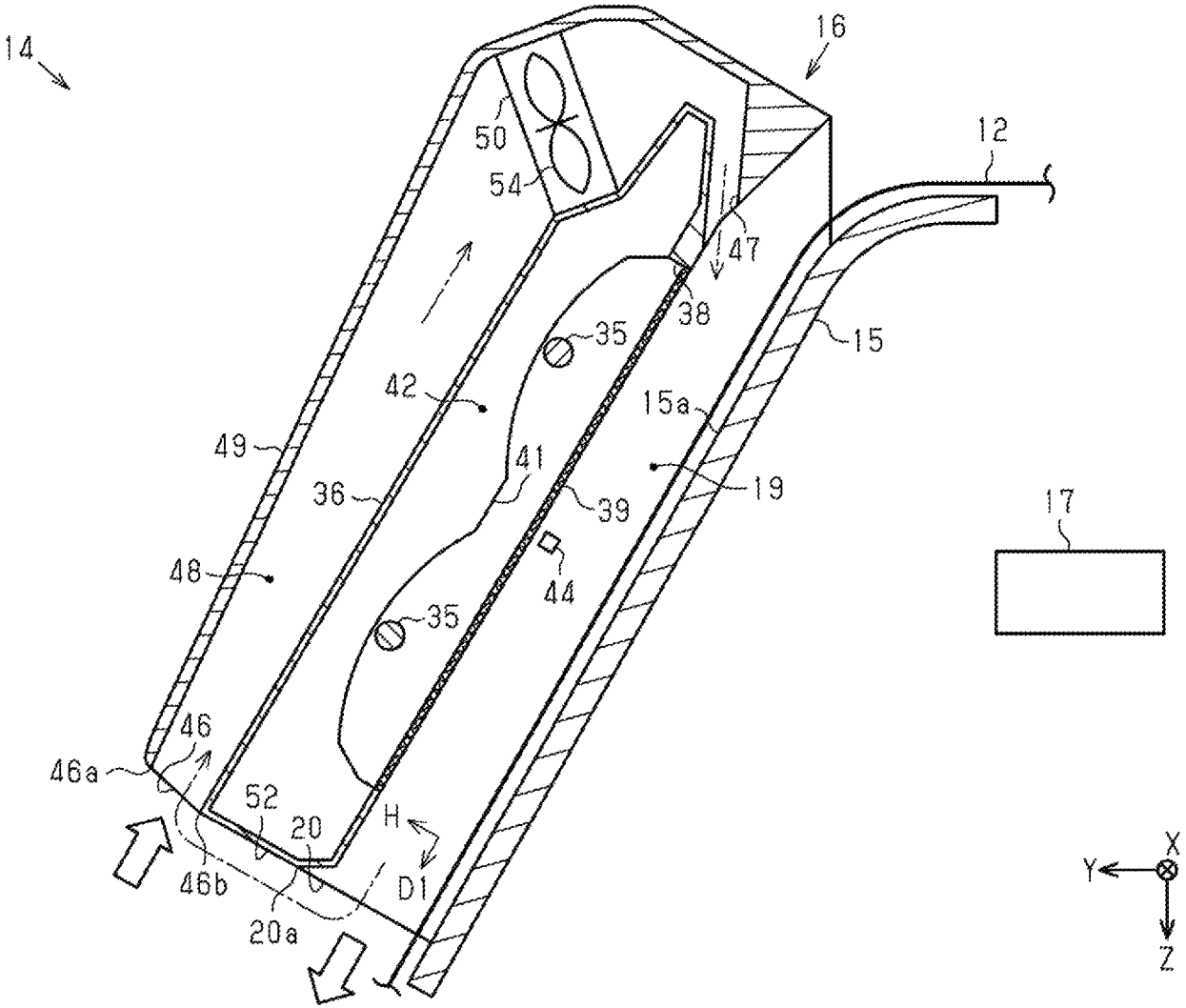
FIG. 2 is a schematic cross-sectional view of a drying device.

As illustrated in FIG. 2, the drying device 14 is provided with a heating unit 35 that emits heat, and a cover 36 that covers the heating unit 35. The drying device 14 is provided with a plurality of the heating units 35. The heating unit 35 may be, for example, a heater that irradiates infrared rays, or may be an electrically heated wire that generates heat when an electric current is applied. Note that the drying device 14 may be configured to include only one of the heating units 35.

The cover 36 may be provided with an opening 38 that is formed facing the support portion 15 or the medium 12 supported by the support portion 15. The drying device 14 may be provided with a wire mesh 39 that covers the opening 38. In a configuration in which the wire mesh 39 is disposed over the opening 38, the heat from the heating unit 35 is transferred to the medium 12 on the support face 15*a* through the wire mesh 39.

The drying device 14 may be provided with a reflection plate 41 that reflects the infrared rays emitted by the heating unit 35 toward the support face 15*a*. When the reflection plate 41 reflects the infrared rays, the medium 12 can be efficiently heated. A heating chamber 42 is formed between the reflection plate 41 and the cover 36, and the drying chamber 19 is formed between the reflecting plate 41 and the support portion 15.

The drying device 14 may be provided with a detector 44 that detects the temperature of the drying chamber 19. The detector 44 may be provided between the reflection plate 41 and the wire mesh 39, or may be provided between the support portion 15 and the wire mesh 39. The detector 44 may detect the temperature of the air in the drying chamber 19, or may detect the temperature of the medium 12, the support portion 15, the reflection plate 41, the wire mesh 39, and the like, of a member configuring the drying chamber 19, or of a member provided inside the drying chamber 19.

The heating unit 35 is provided in the drying chamber 19. The heating unit 35 has a cylindrical shape, for example, and is provided so that the longitudinal direction of the heating unit 35 coincides with the width direction X. When the length of the heating unit 35 is longer than the length of the medium 12 in the width direction X, the heating unit 35 heats the medium 12 over the width direction X. When the plurality of heating units 35 are provided in the normal direction H such that spaces between the heating units 35 and the support portion 15 are the same as each other, uneven heating of the medium 12 can be reduced.

The drying device 14 is provided with a flow path member 49 that forms an air flow path 48 connecting an inflow port 46 and an outflow port 47, and an air blowing unit 50 that is provided in the air flow path 48. The outflow port 47 opens into the drying chamber 19. In other words, the air flow path 48 connects the inflow port 46 and the drying chamber 19.

The inflow port 46 opens downward in the vertical direction Z. An inflow upper end 46*a*, which is an upper end of an edge of the inflow port 46 in the vertical direction Z, and an inflow lower end 46*b*, which is a lower end of the edge of the inflow port 46 in the vertical direction Z, are positioned in different positions with respect to the horizontal direction Y and the vertical direction Z. The inflow lower end 46*b* is positioned closer to the support portion 15 in the horizontal direction Y than the inflow upper end 46*a*. In the flow path member 49, a portion that configures the inflow upper end 46*a* is positioned above the inflow lower end 46*b* in the vertical direction Z.

With respect to the inflow port 46, of directions along a normal line of a virtual plane including the edge of the inflow port 46, a direction toward an opposite side of the virtual plane from the flow path member 49 includes a component of a downward direction in the vertical direction Z. With respect to the inflow port 46, on a virtual plane having the width direction X as a normal line thereof, of directions along a straight line orthogonal to a virtual straight line passing through the inflow upper end 46*a* and the inflow lower end 46*b*, a direction toward an opposite side of the virtual straight line from the flow path member 49 includes the component of the downward direction in the vertical direction Z.

The outflow portion 20 of the drying chamber 19 is positioned lower than the inflow port 46 in the vertical direction Z. The drying device 14 may be provided with an inclined wall 52 positioned between the outflow portion 20 and the inflow port 46. In the normal direction H, the outflow portion 20 is positioned between the inflow port 46 and the support portion 15. The outflow portion 20 and the inflow port 46 are at least partially positioned at the same position in the width direction X. The inclined wall 52 connects an outflow upper end 20*a*, which is an upper end of the outflow portion 20 in the vertical direction Z, and the inflow lower end 46*b* of the inflow port 46, and is provided so as to be inclined with respect to the vertical direction Z. The inclined wall 52 has a length in the normal direction H and the width direction X. The inclined wall 52 is an outer surface of the heating device 16 that faces downward in the vertical direction.

The flow path member 49 is provided on the outer side of the cover 36, and forms the air flow path 48 so as to surround the cover 36. The outflow port 47 is positioned between the heating unit 35 and the printing unit 13 in the transport direction D1. A downstream portion of the air flow path 48 including the outflow port 47 extends so as to be inclined with respect to the support face 15*a*.

The air blowing unit 50 includes a fan 54 that generates an air flow, and causes the air in the air flow path 48 to flow toward the outflow port 47. The air blowing unit 50 supplies the air flowing from the inflow port 46 into the air flow path 48 to the drying chamber 19, and causes the air to flow out of the outflow portion 20, which is included in the drying chamber 19. The air blowing unit 50 causes the air in the drying chamber 19 to flow from upstream to downstream in the transport direction D1. In other words, the air blowing unit 50 blows the air toward the downstream in the transport direction D1, from a position further upstream in the transport direction D1 than the heating unit 35. The air in the drying chamber 19 is discharged to the outside of the drying device 14 from the outflow portion 20 positioned further downstream in the transport direction D1 than the heating unit 35.

Next, a warm-up routine executed by the control unit 17 will be described with reference to a flowchart illustrated in FIG. 3. The control unit 17 executes the warm-up routine at a timing at which the drying device 14 is activated.

Figure 3:
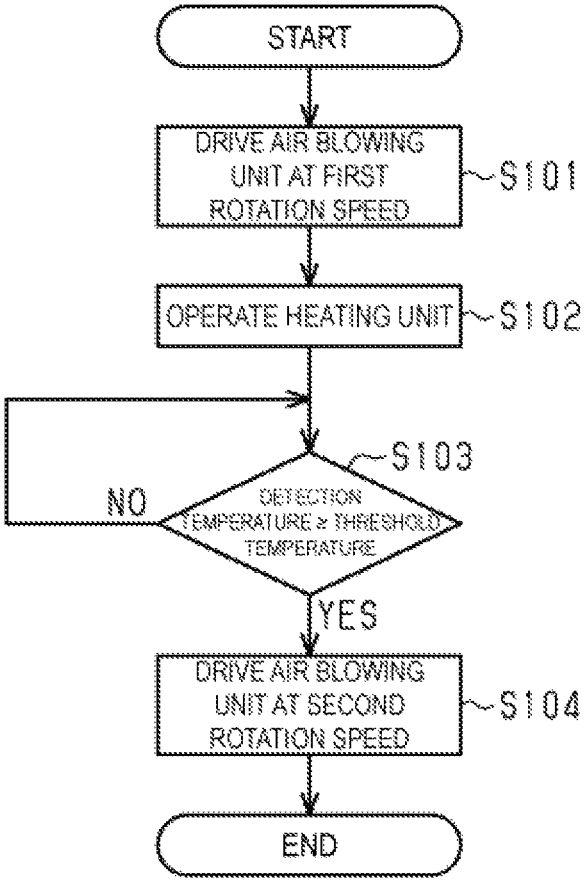
FIG. 3 is a flowchart illustrating a warm-up routine.

As illustrated in FIG. 3, at step S101, the control unit 17 drives the air blowing unit 50 so that a rotation speed of the fan 54 per unit time is a first rotation speed, and supplies the air to the drying chamber 19 at a first air flow rate. At step S102, the control unit 17 operates the heating unit 35.

At step S103, the control unit 17 determines whether or not a detected temperature detected by the detector 44 is equal to or greater than a threshold temperature. When the detected temperature is lower than the threshold temperature, NO is determined at step S103, and the control unit 17 drives the air blowing unit 50 at the first rotation speed until the detected temperature reaches the threshold temperature. When the detected temperature becomes equal to or greater than the threshold temperature, YES is determined at step S103, and the control unit 17 causes the processing to proceed to step S104.

At step S104, the control unit 17 drives the air blowing unit 50 so that the rotation speed of the fan 54 per unit time is a second rotation speed that is greater than the first rotation speed, and supplies the air to the drying chamber 19 at a second air flow rate.

Next, actions of the present embodiment will be described.

The control unit 17 controls the driving of the air blowing unit 50 to change the air flow rate of the air supplied to the drying chamber 19. In other words, when the detected temperature detected by the detector 44 is lower than the threshold temperature, the control unit 17 supplies the air to the drying chamber 19 at the first air flow rate that is less than the second air flow rate.

When the air blowing unit 50 supplies the air to the drying chamber 19 from upstream to downstream in the transport direction D1, warmed air in the drying chamber 19 flows out of the outflow portion 20 positioned at the downstream end in the transport direction D1. The air velocity of the air flowing out of the outflow portion 20 varies depending on the air flow rate of the air flowing into the drying chamber 19. In other words, when the air is supplied to the drying chamber 19 at the first air flow rate, a first air velocity of the air flowing out of the outflow port 47 is slower than a second air velocity of the air flowing out when the air is supplied to the drying chamber 19 at the second air flow rate.

When the air is discharged from the outflow portion 20 at the first air flow rate, the air heated in the drying chamber 19 rises along the inclined wall 52, and is easily introduced into the air flow path 48 from the inflow port 46. Thus, the air circulates through the air flow path 48, the drying chamber 19, and a space outside the drying device 14, as indicated by alternate long and short dash line arrows in FIG. 2. When the warmed air is circulated, the support portion 15, the cover 36, the flow path member 49, and the like can be efficiently warmed.

When the detected temperature detected by the detector 44 becomes equal to or greater than the threshold temperature, the control unit 17 supplies the air to the drying chamber 19 at the second air flow rate that is greater than the first air flow rate. The threshold temperature may be a predetermined value set in accordance with characteristics of the drying device 14, or may be a value corresponding to a target temperature set in accordance with a type of the medium 12 and a print mode. For example, the threshold temperature for drying the medium 12 that has excellent heat resistance may be higher than the threshold temperature for drying the medium 12 that is easily affected by heat. When printing is performed in which the amount of liquid to be deposited per unit area of the medium 12 is large, the threshold temperature may be higher than the threshold temperature applied when printing is performed in which the amount of liquid to be deposited per unit area is small.

After the detected temperature exceeds the threshold temperature, the control unit 17 maintains a state in which the air is supplied to the drying chamber 19 at the second air flow rate. In other words, the control unit 17 maintains the air flow at the second air flow rate even when the detected temperature falls below the threshold temperature. Thus, after the end of the warm-up routine, during a drying period of drying the medium 12, the air is being supplied to the drying chamber 19 at the second air flow rate.

When the heating unit 35 heats the printed medium 12, the liquid deposited on the medium 12 evaporates, and steam is generated. The humidity in the drying chamber 19 increases due to the steam, and the medium 12 becomes less likely to be dried. In this regard, the drying device 14 blows air onto the medium 12 while heating the medium 12 supported by the support face 15*a*. The air in the drying chamber 19 flows out of the outflow portion 20 by the amount supplied from the air blowing unit 50. The steam generated as a result of drying the medium 12 is discharged to the outside of the drying device 14 together with the air in the drying chamber 19. When the air is supplied to the drying chamber 19 at the second air flow rate, the air in the drying chamber 19 flows out of the outflow portion 20 with significant force compared to when the air is supplied to the drying chamber 19 at the first air flow rate. As illustrated by outlined arrows in FIG. 2, the air that has flowed out with the significant force is less likely to return to the inflow port 46. Thus, the outside air having low humidity readily enters the inflow port 46, and an increase in humidity in the drying chamber 19 is suppressed.

Effects of the present embodiment will now be described.

The air supplied to the drying chamber 19 is heated by the heating unit 35. The inflow port 46 opens downward in the vertical direction Z. The outflow portion 20 is positioned lower than the inflow port 46 in the vertical direction Z. Thus, when the control unit 17 changes the air flow rate of the air supplied to the drying chamber 19, of the air flowing out from the outflow portion 20, the amount of air returning to the inflow port 46 can be changed. In other words, when the air flow rate supplied to the drying chamber 19 is small, the air velocity of the air flowing out of the outflow portion 20 is slow, so the amount of air returning to the inflow port 46 increases. Thus, heated air can be circulated to efficiently warm the drying chamber 19. When the air flow rate of the air supplied to the drying chamber 19 is large, the air velocity of the air flowing out of the outflow portion 20 is fast, so the amount of air returning to the inflow port 46 decreases. Thus, the air having a high humidity can be discharged out of the device. Therefore, by controlling the driving of the air blowing unit 50 in accordance with the case in which the drying chamber 19 is to be heated and the case in which the medium 12 is to be dried, condensation can be reduced while efficiently warming the drying chamber 19.

When the detected temperature is lower than the threshold temperature, the control unit 17 supplies the air at the first air flow rate. The air supplied at the first air flow rate can easily return to the inflow port 46 and efficiently warm the drying chamber 19. When the detected temperature is equal to or greater than the threshold temperature, the control unit 17 increases the air flow rate and supplies the air at the second air flow rate. The air supplied at the second air flow rate is less likely to return to the inflow port 46, so the outside air is more likely to flow into the inflow port 46. Thus, a risk of the temperature of the air passing through the air blowing unit 50 increasing excessively can be reduced.

The support portion 15 supports the medium 12 transported downstream in the transport direction D1 from the print position P. In other words, the medium 12 is transported downstream in the transport direction D1, from the print position P positioned further upstream in the transport direction D1 than the drying device 14. The air blowing unit 50 causes the air in the drying chamber 19 to flow in the same direction as the direction in which the medium 12 is transported. Thus, compared to a case in which the air in the drying chamber 19 is caused to flow in an opposite direction to the direction in which the medium 12 is transported, a risk of the air flowing out of the drying chamber 19 flowing toward the print position P can be reduced.

The air velocity of the air flowing out of the outflow portion 20 can also be varied by changing the shape and size of the outflow portion 20. Thus, the drying device 14 may change the air velocity of the air flowing out of the outflow portion 20 by including a movable member for changing the shape and size of the outflow portion 20. However, when the movable member is provided, the configuration becomes complex. In this regard, the air blowing unit 50 changes the rotation speed of the fan 54 to change the air velocity of the air flowing out of the outflow portion 20. Therefore, the air velocity of the air flowing out of the outflow portion 20 can be changed while preventing the configuration from becoming more complex.

When the air blowing unit 50 changes the rotation speed of the fan 54, the air flow rate of the air flowing in from the inflow port 46 also changes. When the air is supplied to the drying chamber 19 at the second air flow rate that is greater than the first air flow rate, a second inflow amount of the air flowing in from the inflow port 46 is greater than a first inflow amount of the air flowing in from the inflow port 46 when the air is supplied to the drying chamber 19 at the first air flow rate. Thus, when the air blowing unit 50 supplies the air to the drying chamber 19 at the second air flow rate, more air can be taken in than when the air is supplied at the first air flow rate. Thus, the air blowing unit 50 can efficiently exchange air in the drying chamber 19.

The air flowing out of the outflow portion 20 after drying the medium 12 has a high humidity and temperature. When the air having a high temperature hits the printing unit 13, there is a risk that so-called nozzle clogging may occur, in which the nozzle is clogged and becomes unable to eject the liquid. The air having a high humidity may cause condensation. In this regard, the outflow portion 20 is positioned in a position further separated from the printing unit 13 than the heating unit 35, and causes the air to flow out toward the opposite side to the printing portion 13. Thus, an influence of the air flowing out of the outflow portion 20 on the printing unit 13 can be reduced.

Second Embodiment

Next, a second embodiment of the printing apparatus will be described with reference to the drawings. Note that control executed by the control unit 17 is different from that of the first embodiment in this second embodiment. Further, since other points are substantially the same as those of the first embodiment, duplicate descriptions of the same configuration will be omitted while assigning the same reference signs to the same components.

The control unit 17 of the present embodiment determines whether or not the support portion 15 supports the printed medium 12. The control unit 17 may determine whether or not the support portion 15 is supporting the printed medium 12 on the basis of the length of a transport path of the medium 12 from the print position P to the drying chamber 19 and the transport speed at which the medium 12 is transported. In other words, the control unit 17 determines that the support portion 15 is supporting the printed medium 12 after a transport time has elapsed, which is a time required to transport a printed portion of the medium 12 to the drying chamber 19 from a time at which the printing unit 13 starts the printing. The control unit 17 determines that the support portion 15 is not supporting the printed medium 12 after the transport time has elapsed from a time at which the printing unit 13 finishes the printing. Note that in the present embodiment, the control unit 17 determines whether or not the support portion 15 is supporting the printed medium 12 on the basis of the elapsed time from the time at which the printing unit 13 starts the printing, but the control unit 17 may use a separately provided image sensor to detect whether or not an image is present on the surface of the medium 12, and may determine whether or not the support portion 15 is supporting the printed medium 12 on the basis of this detection.

Next, a drying routine executed by the control unit 17 will be described with reference to a flowchart illustrated in FIG. 4. The control unit 17 executes the drying routine at a timing at which the drying device 14 is activated.

Figure 4:
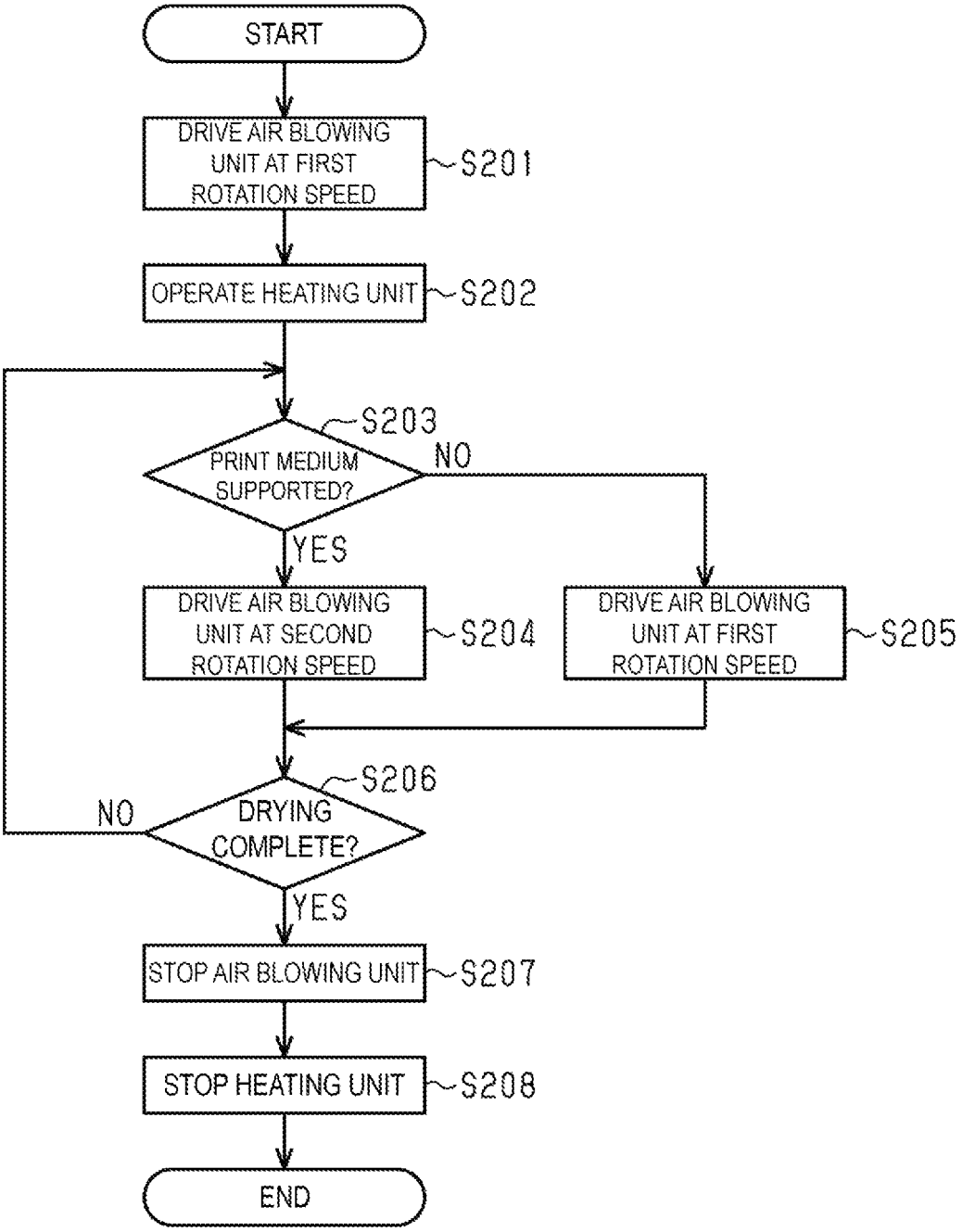
FIG. 4 is a flowchart illustrating a drying routine of a second embodiment.

As illustrated in FIG. 4, at step S201, the control unit 17 drives the air blowing unit 50 so that the rotation speed of the fan 54 per unit time is the first rotation speed, and supplies the air to the drying chamber 19 at the first air flow rate. At step S202, the control unit 17 operates the heating unit 35.

At step S203, the control unit 17 determines whether or not the support portion 15 supports the printed medium 12. When the support portion 15 supports the printed medium 12, YES is determined at step S203, and the control unit 17 causes the processing to proceed to step S204. At step S204, the control unit 17 drives the fan 54 at the second rotation speed, and supplies the air to the drying chamber 19 at the second air flow rate.

When the support portion 15 does not support the printed medium 12, NO is determined at step S203, and the control unit 17 causes the processing to proceed to step S205. At step S205, the control unit 17 drives the fan 54 at the first rotation speed, and supplies the air to the drying chamber 19 at the first air flow rate.

At step S206, the control unit 17 determines whether or not the printing apparatus 11 has finished the printing and the drying device 14 has finished drying the medium 12. When the drying is not complete, NO is determined at step S206, and the control unit 17 causes the processing to proceed to step S203. When the drying is complete, YES is determined at step S206, and the control unit 17 causes the processing to proceed to step S207. At step S207, the control unit 17 stops driving the air blowing unit 50. At step S208, the control unit 17 stops operating the heating unit 35.

Next, actions of the present embodiment will be described.

When the support portion 15 does not support the printed medium 12, the control unit 17 supplies the air to the drying chamber 19 at the first air flow rate that is less than at the second air flow rate. When the support portion 15 does not support the printed medium 12, the humidity inside the drying chamber 19 is less likely to increase. Thus, the warmed air in the drying chamber 19 can be circulated to efficiently warm the support portion 15, the cover 36, the flow path member 49, and the like.

When the support portion 15 supports the printed medium 12, the liquid attached to the heated medium 12 evaporates, and steam is generated, which tends to increase the humidity inside the drying chamber 19. As a result, the air flowing out of the outflow portion 20 becomes air having high humidity.

When the support portion 15 supports the printed medium 12, the control unit 17 supplies the air to the drying chamber 19 at the second air flow rate that is greater than the first air flow rate. When the air is supplied to the drying chamber 19 at the second air flow rate, the air flowing out of the outflow portion 20 is less likely to return to the inflow port 46 compared to a case in which the air is supplied at the first air flow rate that is less than the second air flow rate. Since the air returning to the inflow port 46 decreases, the outside air having low humidity easily enters the inflow port 46, and an increase in humidity in the drying chamber 19 is suppressed.

Effects of the present embodiment will now be described.

(7) When the support portion 15 does not support the printed medium 12, the control unit 17 supplies the air at the first air flow rate. The air supplied at the first air flow rate can easily return to the inflow port 46 and efficiently warm the drying chamber 19. When the support portion 15 supports the printed medium 12, the control unit 17 increases the air flow rate and supplies the air at the second air flow rate. The air supplied at the second air flow rate is less likely to return to the inflow port 46, so the outside air is more likely to flow into the inflow port 46. Therefore, the air having an increased humidity as a result of drying the medium 12 can be easily discharged.

The present embodiment described above may be modified as follows. The present embodiment and modified examples thereof to be described below may be implemented in combination within a range in which a technical contradiction does not arise.

Figure 5:
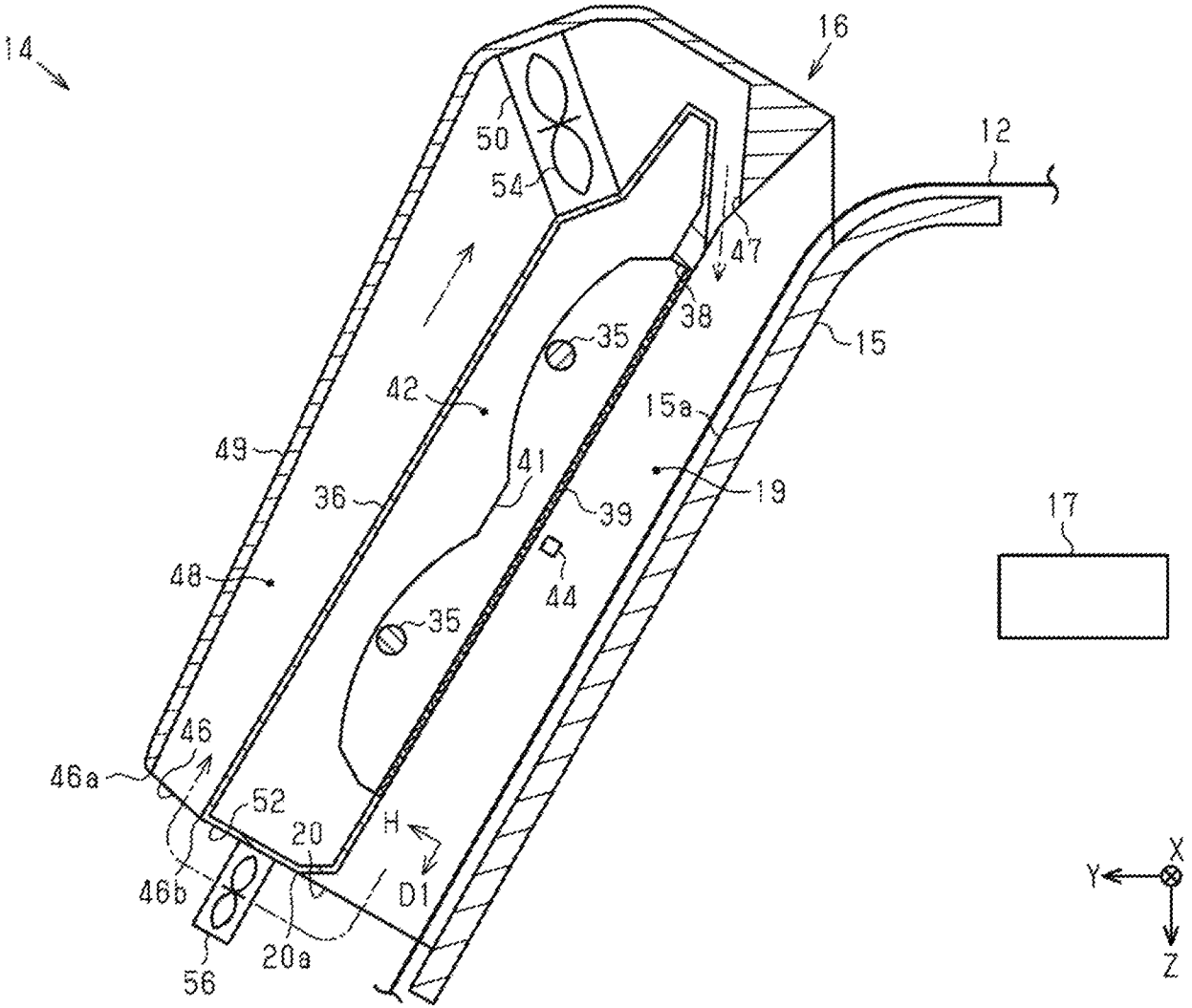
FIG. 5 is a schematic cross-sectional view of the drying device of a modified example.

As illustrated in FIG. 5, the drying device 14 may be provided with an air blower 56 capable of guiding the air flowing out from the outflow portion 20 into the inflow port 46. The air blower 56 may be provided on the inclined wall 52. When the control unit 17 drives the air blowing unit 50 to supply the air to the drying chamber 19 at the first air flow rate, the control unit 17 may drive the air blower 56 to guide the air flowing out of the outflow portion 20 to the inflow port 46. When the control unit 17 drives the air blowing unit 50 to supply the air to the drying chamber 19 at the second air flow rate, the control unit 17 may stop driving the air blower 56.

The drying chamber 19 may include a discharge portion for discharging the medium 12 separately from the outflow portion 20.

The medium 12 to be dried by the drying device 14 is not limited to the long medium 12, and may be a medium of a single sheet. The drying device 14 may include a sensor for detecting the presence or absence of the medium supported by the support portion 15. Based on the detection result of the sensor, the control unit 17 may supply the air at the first air flow rate when the support portion 15 does not support the medium, and may supply the air at the second air flow rate when the support portion 15 supports the medium.

After the detected temperature exceeds the threshold temperature and the control unit 17 drives the air blowing unit 50 at the second rotation speed, the control unit 17 may control the driving of the air blowing unit 50 depending on whether or not the support portion 15 supports the printed medium 12. For example, after executing the warm-up routine illustrated in FIG. 3, the control unit 17 may execute the drying routine illustrated in FIG. 4 from step S203.

The control unit 17 may switch the air flow rate supplied to the drying chamber 19 in three or more stages. For example, after the detected temperature exceeds the threshold temperature, when the detected temperature falls below the threshold temperature, the control unit 17 may supply the air at a third air flow rate, which is greater than the first air flow rate and less than the second air flow rate.

The air blowing unit 50 may blow the air toward the support face 15*a* in the normal direction H. The air blowing unit 50 may cause the air in the drying chamber 19 to flow in a direction opposite to the transport direction D1.

The drying device 14 may be provided separately from the printing apparatus that performs the printing on the medium 12.

The printing apparatus 11 may be an apparatus that prints an image such as characters, pictures, photographs, and the like by depositing a liquid such as ink on the medium 12, and may be a serial printer, a lateral printer, a line printer, a page printer, or the like. Further, the printing apparatus may be an offset printing apparatus, a textile printing apparatus, or the like.

Hereinafter, technical concepts and effects thereof that are understood from the above-described embodiments and modified examples will be described.

A drying device includes a support portion configured to support a printed medium, a heating unit provided in a drying chamber for drying the medium supported by the support portion, a flow path member forming an air flow path connecting an inflow port that opens downward in a vertical direction and the drying chamber, an air blowing unit configured to supply air, flowing from the inflow port into the air flow path, to the drying chamber and cause the air to flow out of an outflow portion of the drying chamber, and a control unit configured to control driving of the air blowing unit. The outflow portion is positioned lower than the inflow port in the vertical direction, and the control unit controls the driving of the air blowing unit to change an air flow rate of the air supplied to the drying chamber.

According to this configuration, the air supplied to the drying chamber is heated by the heating unit. The inflow port opens downward in the vertical direction. The outflow portion is positioned lower than the inflow port in the vertical direction. Thus, when the control unit changes the air flow rate of the air supplied to the drying chamber, of the air flowing out of the outflow portion, the amount of air returning to the inflow port can be changed. In other words, when the air flow rate of the air supplied to the drying chamber is small, the air velocity of the air flowing out from the outflow portion is slow, so the amount of air returning to the inflow port increases. Thus, heated air can be circulated to efficiently warm the drying chamber. When the air flow rate of the air supplied to the drying chamber is large, the air velocity of the air flowing out of the outflow portion is fast, so the amount of air returning to the inflow port decreases. Thus, air having a high humidity can be discharged out of the device. Therefore, by controlling the driving of the air blowing unit in accordance with the case in which the drying chamber is to be warmed and the case in which the medium is to be dried, condensation can be reduced while efficiently warming the drying chamber.

The drying device may further include a detector configured to detect a temperature of the drying chamber. When a detected temperature detected by the detector is lower than a threshold temperature, the control unit may supply the air to the drying chamber at a first air flow rate, and when the detected temperature is equal to or greater than the threshold temperature, the control unit may supply the air to the drying chamber at a second air flow rate that is greater than the first air flow rate.

According to this configuration, when the detection temperature is lower than the threshold temperature, the control unit supplies the air at the first air flow rate. The air supplied at the first air flow rate can easily return to the inflow port and efficiently warm the drying chamber. When the detection temperature is equal to or greater than the threshold temperature, the control unit increases the air flow rate and supplies the air at the second air flow rate. The air supplied at the second air flow rate is less likely to return to the inflow port, so the outside air easily flows into the inflow port. Thus, the risk of the temperature of the air passing through the air blowing unit excessively increasing can be reduced.

In the drying device, when the support portion does not support the printed medium, the control unit may supply the air to the drying chamber at a first air flow rate, and when the support portion supports the printed medium, the control unit may supply the air to the drying chamber at a second air flow rate that is greater than the first air flow rate.

According to this configuration, when the support portion does not support the printed medium, the control unit supplies the air at the first air flow rate. The air supplied at the first air flow rate can easily return to the inflow port and efficiently warm the drying chamber. When the support portion supports the printed medium, the control unit increases the air flow rate and supplies the air at the second air flow rate. The air supplied at the second air flow rate is less likely to return to the inflow port, so the outside air easily flows into the inflow port. Therefore, air having an increased humidity as a result of drying the medium can be easily discharged.

In the drying device, the support portion may support the medium transported downstream in a transport direction from a print position at which printing is performed, and the air blowing unit may cause the air in the drying chamber to flow from upstream to downstream in the transport direction.

According to this configuration, the support portion supports the medium transported downstream in the transport direction from the print position. In other words, the medium is transported downstream in the transport direction, from the print position positioned further upstream in the transport direction than the drying device. The air blowing unit causes the air in the drying chamber to flow in the same direction as the direction in which the medium is transported. Thus, compared to a case in which the air in the drying chamber is caused to flow in the direction opposite to the direction in which the medium is transported, the risk of the air flowing out from the drying chamber flowing toward the print position can be reduced.

A printing apparatus includes a printing unit configured to perform printing on a medium, a support portion configured to support the printed medium, a heating unit provided in a drying chamber for drying the medium supported by the support portion, a flow path member forming an air flow path connecting an inflow port that opens downward in a vertical direction and the drying chamber, an air blowing unit configured to supply air, flowing from the inflow port into the air flow path, to the drying chamber and cause the air to flow out of an outflow portion of the drying chamber, and a control unit configured to control driving of the air blowing unit. The outflow portion is positioned lower than the inflow port in the vertical direction, and the control unit controls the driving of the air blowing unit to change an air flow rate of the air supplied to the drying chamber.

According to this configuration, the same effect as the drying device described above can be obtained.

What is claimed is:

1. A drying device comprising:

a support portion configured to support a printed medium;

a heating unit provided in a drying chamber for drying the medium supported by the support portion;

a flow path member forming an air flow path connecting an inflow port that opens downward in a vertical direction and the drying chamber;

an air blowing unit configured to supply air, flowing from the inflow port into the air flow path, to the drying chamber and to cause the air to flow out of an outflow portion of the drying chamber;

a detector configured to detect a temperature of the drying chamber; and a control unit configured to control driving of the air blowing unit, wherein the outflow portion is positioned lower than the inflow port in the vertical direction, the outflow portion is positioned substantially at the same location as the inflow port in a transport direction of the medium, the control unit controls the driving of the air blowing unit to change an air flow rate of the air supplied to the drying chamber, when a detected temperature detected by the detector is lower than a threshold temperature, the control unit supplies the air to the drying chamber at a first air flow rate, and when the detected temperature is equal to or greater than the threshold temperature, the control unit supplies the air to the drying chamber at a second air flow rate that is greater than the first air flow rate, and the outflow portion opens substantially in the same direction as the inflow port.

2. The drying device according to claim 1, wherein when the support portion does not support the printed medium, the control unit supplies the air to the drying chamber at a first air flow rate, and when the support portion supports the printed medium, the control unit supplies the air to the drying chamber at a second air flow rate that is greater than the first air flow rate.

3. The drying device according to claim 1, wherein the support portion supports the medium transported downstream in a transport direction from a print position at which printing is performed on the medium, and the air blowing unit causes the air in the drying chamber to flow from upstream to downstream in the transport direction.

4. The drying device according to claim 1, wherein the air blowing unit is positioned upstream in a transport direction of the medium than the heating unit.

5. The drying device according to claim 1, wherein the air flow path includes a bent portion, and the air blowing unit is positioned at the bent portion.

6. A printing apparatus comprising:

a printing unit configured to perform printing on a medium;

a support portion configured to support the printed medium;

a heating unit provided in a drying chamber that for drying the medium supported by the support portion;

a flow path member forming an air flow path connecting an inflow port that opens downward in a vertical direction and the drying chamber;

an air blowing unit configured to supply air, flowing from the inflow port into the air flow path, to the drying chamber and to cause the air to flow out of an outflow portion of the drying chamber;

a detector configured to detect a temperature of the drying chamber; and a control unit configured to control driving of the air blowing unit, wherein the outflow portion is positioned lower than the inflow port in the vertical direction, the outflow portion is positioned substantially at the same location as the inflow port in a transport direction of the medium, the control unit controls the driving of the air blowing unit to change an air flow rate of the air supplied to the drying chamber, when a detected temperature detected by the detector is lower than a threshold temperature, the control unit supplies the air to the drying chamber at a first air flow rate, and when the detected temperature is equal to or greater than the threshold temperature, the control unit supplies the air to the drying chamber at a second air flow rate that is greater than the first air flow rate, and the outflow portion opens substantially in the same direction as the inflow port.

7. The printing apparatus according to claim 6, wherein the air blowing unit is positioned upstream in a transport direction of the medium than the heating unit.

8. The printing apparatus according to claim 6, wherein the air flow path includes a bent portion, and the air blowing unit is positioned at the bent portion.

9. A drying device comprising:

a support portion configured to support a printed medium;

a heating unit provided in a drying chamber for drying the medium supported by the support portion;

a flow path member forming an air flow path connecting an inflow port that opens downward in a vertical direction and the drying chamber;

an air blowing unit configured to supply air, flowing from the inflow port into the air flow path, to the drying chamber via an outflow port that opens toward the support portion and to cause the air to flow out of an outflow portion of the drying chamber;

a detector configured to detect a temperature of the drying chamber; and a control unit configured to control driving of the air blowing unit, wherein the outflow portion is positioned lower than the inflow port in the vertical direction, the air blow unit is positioned closer to the outflow port than the inflow port in the air flow path, the control unit controls the driving of the air blowing unit to change an air flow rate of the air supplied to the drying chamber, when a detected temperature detected by the detector is lower than a threshold temperature, the control unit supplies the air to the drying chamber at a first air flow rate, when the detected temperature is equal to or greater than the threshold temperature, the control unit supplies the air to the drying chamber at a second air flow rate that is greater than the first air flow rate, and the outflow portion opens substantially in the same direction as the inflow port.

10. The printing apparatus according to claim 9, wherein the air blowing unit is positioned upstream in a transport direction of the medium than the heating unit.

11. The printing apparatus according to claim 9, wherein the air flow path includes a bent portion, and the air blowing unit is positioned at the bent portion.

* * * * *